US005353781A

United States Patent [19]

Calvillo

[11] Patent Number: 5,353,781

[45] Date of Patent: Oct. 11, 1994

[54] COOK TOP PROTECTOR

[76] Inventor: Max Calvillo, 5020 Blackpool Ave., Agoura, Calif. 91301

[21] Appl. No.: 103,568

[22] Filed: Aug. 9, 1993

[51] Int. Cl.[5] ..... F24C 3/00

[52] U.S. Cl. ..... 126/39 M; 126/221

[58] Field of Search ..... 126/39 M, 42, 211, 214 R, 126/220, 221, 24

[56] References Cited

U.S. PATENT DOCUMENTS

| | | | |
|---|---|---|---|
| 727,251 | 5/1903 | Allen | 126/221 |
| 3,490,123 | 1/1970 | Clark | 126/39 M |
| 5,117,807 | 6/1992 | Graulich | 126/42 |

FOREIGN PATENT DOCUMENTS

| | | | |
|---|---|---|---|
| 2318099 | 10/1974 | Fed. Rep. of Germany | 126/39 M |
| 2342580 | 3/1975 | Fed. Rep. of Germany | 126/221 |
| 2626965 | 8/1989 | France | 126/39 M |

*Primary Examiner*—James C. Yeung
*Attorney, Agent, or Firm*—J. E. Brunton

[57] ABSTRACT

A protective cook top cover which is constructed of a fire retardant, flexible, cloth-like material that can be conveniently laid over the cook top to prevent the cook top and the burners not being used at the particular time from being splattered and otherwise soiled with food particles. After becoming soiled, the cover can be placed in a conventional washing machine to be washed and then placed into a dryer or hung out to air dry. A plurality of fingers or cutout portions are provided in the area of each of the range burners so that the fingers can be positioned in close proximity to one another in a manner to substantially cover the surfaces of the burner wells.

15 Claims, 3 Drawing Sheets

COOK TOP PROTECTOR

BACKGROUND OF THE INVENTION

1. Field of the Invention

The present invention relates generally to protective coverings for the cooking surfaces of cooking ranges. More particularly, the invention concerns a fire retardant, flexible cover which is designed to fit over a conventional stove to protect the cook top thereof from splattering grease and the like.

2. Discussion of the Invention

It is well known that while cooking on a typical stove top, either gas or electric, it is not uncommon for spilling, splattering and the like to take place. Particularly in frying operations, the stove top becomes quite messy and typically requires a substantial amount of difficult hand clean up. As a general rule, while cooking on one or more burners, the adjacent burners as well as other areas proximate the burners inevitably become messy and covered with splattered grease and food particles further exacerbating the clean-up process.

While cooking with a gas stove, if materials, such as grease, splatters onto adjacent burners, the orifices thereof can become clogged, causing the stove to operate improperly. When this occurs, the orifices in the burner must be meticulously cleaned using a pointed utensil or like article. This is not only annoying but quite labor intensive. While cooking with an electric stove, the electric heating elements or burners similarly become messy. Since the electric heating elements are typically irregular and uneven and do not present a smooth surface cleaning of the messy elements can also be quite difficult and time consuming. Additionally, when the burners become contaminated, a highly unpleasant burning odor results and on some occasions, the contaminants are so baked onto the surfaces of the burner that cleaning with normal cleaning materials becomes almost impossible.

Many prior art devices have been suggested to alleviate the types of problems identified in the preceding paragraphs. For example, in U.S. Pat. No. 4,361,132 issued to Adkins, a stove cover comprising four panels secured together and selectively movable to cover and uncover one or more of the stove burners is was suggested. Another approach to solving the cook top contamination problem is addressed in U.S. Pat. No. 5,158,068 issued to Pickering. This patent describes a cook top cover system having at least one cook top cover recessed within a surrounding framework to provide a flat surface when the cooking surface positioned under the cover is not in use. The cover comprises a generally flat plate-like member with a plurality of support legs attached to the plate-like member and extending downwardly therefrom to detachably engage a rigid planar member positioned under the plate-like member. In U.S. Pat. No. 5,115,797, a cover for stoves particularly designed for use in mobile vehicles is there disclosed. The apparatus of this patent comprises a stove cook top cover that engages the cooking utensils support racks that surround the burners. Similarly in a very early patent, U.S. Pat. No. 1,240,745 issued to Love, a folded range cover construction is described. The device described in this patent is so constructed that, when the forward portion of the range is in use, the finished side of one portion of the cover is folded on the finished side of the other portion so that the finished sides are protected during use of the range.

A drawback common to many of the prior art devices, is that the covering devices are somewhat heavy, are of cumbersome design and are difficult to use. Such coverings are generally expensive to manufacture and tend to themselves become spattered with grease and cooking particles thereby merely transferring the difficult surface cleaning problem from the cook top itself to the cover apparatus. The thrust of the present invention is to elegantly overcome the problems exhibited by the prior art devices by providing a simple, easy-to-use, lightweight, flexible, cloth-like cover that can be easily emplaced over the cook top prior to cooking and then, as necessary, can be removed and expeditiously cleaned by merely washing the cover in a conventional washing machine.

In the preferred form of the invention, the protective cover comprises a main body portion and a plurality of fabric panels that are removably connected to the main body. In use the removable panels cover all portions of the cook top other than the portions actually being used to accomplish the cooking. Another important feature of the cook top cover resides in the fact that the body portion includes a plurality of downwardly depending flaps or fingers which are provided in those portions of the cover that overlay the burners. The flexible fingers are so constructed and arranged that they can be folded beneath the burner grates so as to cover the sump area which is normally located beneath the burner grates of the stove. At the start of the cooking operation, only the panels that cover the burners to be used are removed. The area of the cook top not being, such as the griddle area, used remains completely covered by removable panels thereby providing protection to adjacent burners as to those well as areas of the cook top intermediate the burners. When it is desired to use an additional burner or the griddle portion of the stove, the removable panels covering the burners or the griddle can be quickly removed and stored for later use.

Periodically, the entire cover, including some or all of the removable panels can be placed into a washing machine and washed in a conventional manner thereby avoiding the difficult and time consuming hand clean up of the cook top as well as the individual gas or electric burner units. Because the fingers or flaps of the protective cover can be closely arranged beneath the pan supporting grates, even the sump areas of the burner assemblies are protected from boil-over, messy spattering and contamination with food particles. Since the cover is constructed of a fire-proof material, the cover is completely safe to use and will not be damaged during cooking operations either by the heat from the burners themselves, or from the hot grease or particles of food spattered onto the cover.

In one form of the invention, the protective cover is also provided with a downwardly depending front skirt which is provided with conveniently located pockets for holding various types of utensils such as spatulas, spoons, forks and the like. This skirt portion is also constructed from a fully washable fire-proof, flexible cloth-like material.

SUMMARY OF THE INVENTION

It is an object of the present invention to provide a protective cook top cover which is constructed of a fire retardant, flexible cloth-like material that can be conveniently laid over the cook top to prevent the cook top and the burners not being used at the particular time from being splattered and otherwise contaminated with food particles. The cover is uniquely constructed so that after becoming soiled, it can be placed in a conventional washing machine to be washed and then placed into a dryer or hung out to air dry. In one from of the cover of the invention, a plurality of fingers or cutout portions are provided in the area of each of the range burners so that the fingers can be positioned in close proximity to one another in a manner to cover the sump portions.

Another object of the invention to provide a cook top cover of the aforementioned character which is lightweight, is durable in use, and, when not in use, is easily foldable for convenient storage in a dish towel drawer or the like.

Another object of the invention is to provide a cover of the character described which includes a body portion and a plurality of flexible panels which are removably connected to the body portion. The panels are adapted to cover the various areas of the stove top which are not presently being used as for example, griddle areas and adjacent burners. The removable panels can be easily separated from the cover body and then replaced after cooking or, alternatively, they can be washed in a conventional washing machine prior to being replaced.

Another object of the invention is to provide a cook top cover of the class described which is attractive in design and is extremely easy to emplace over any cook top of standard design.

Another object of the invention is to provide a protective cook top cover of the character described in the preceding paragraphs which includes at least one depending skirt portion which is provided with pockets adapted to hold various types of utensils that are commonly used during the cooking operation.

Still another object of the invention is to provide a stove-top cover that is simple and easy to use, and which lends itself to economic fabrication so as to be commercially produceable at a reasonable price.

These and other objects of the invention will become clear from the description which follows:

DESCRIPTION OF THE INVENTION

Figure 1:
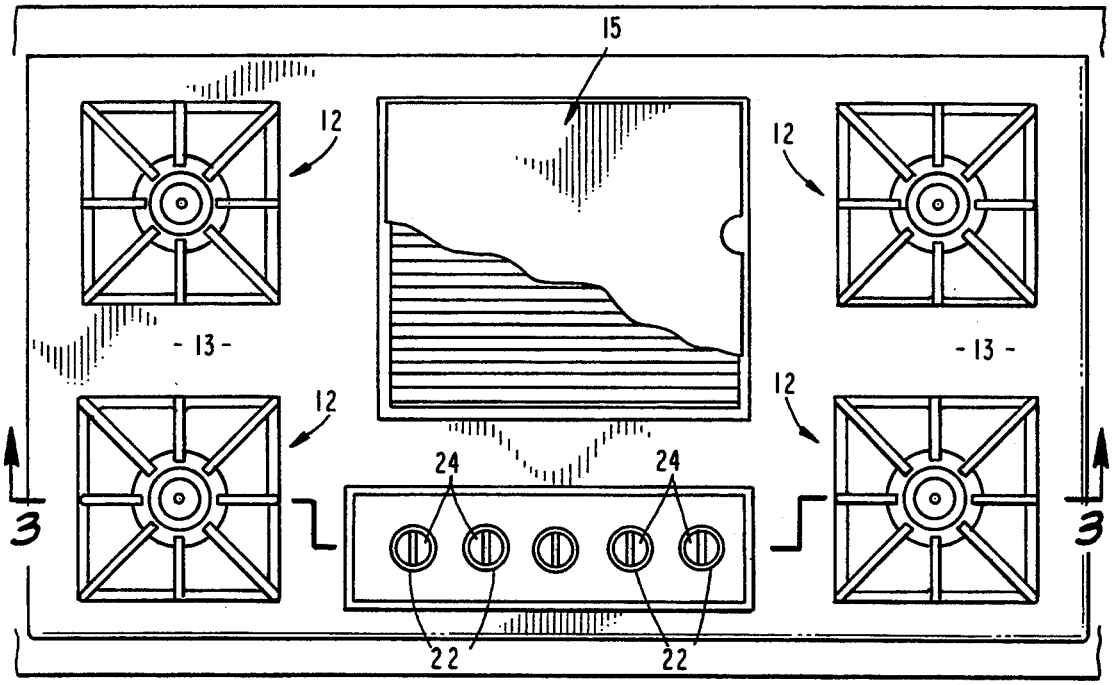
FIG. 1 is a plan view of a typical cooking range.

Referring to the drawings and particularly to FIGS. 1 through 4, one form of the protective cover of the present invention for use with a stove top of the character shown in FIG. 1 is there illustrated. The protective cover is suitable for use with a wide variety of both electric and gas stoves of the character having at least two burner locations such as burner locations 12 (FIG. 1), which locations are surrounded by a generally, planar smooth stove top surface 13. One form of the protective cover is also suitable for use with a stove top having a griddle portion of the character generally designated in FIG. 1 by the numeral 15.

Figure 2:
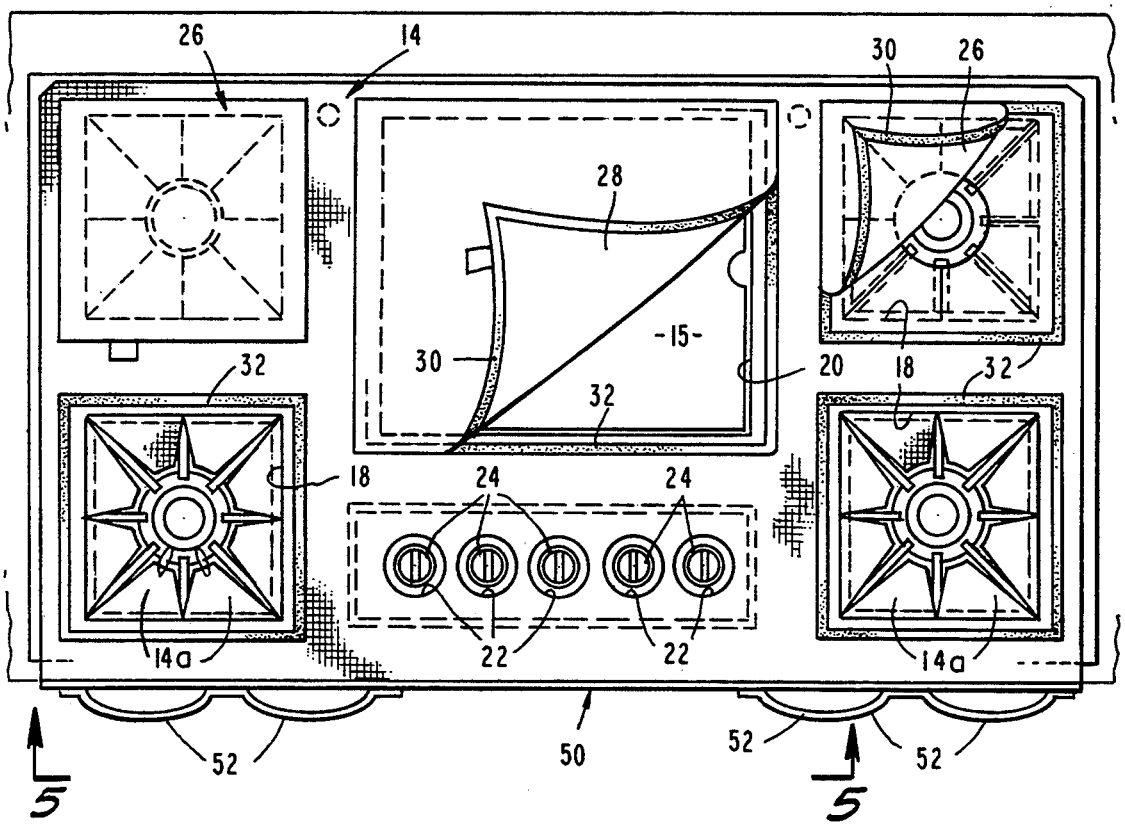
FIG. 2 is a plan view similar to FIG. 1 showing one form of the protective cover of the present invention in position over the range top.
Figures 3, 4, 5, 6:
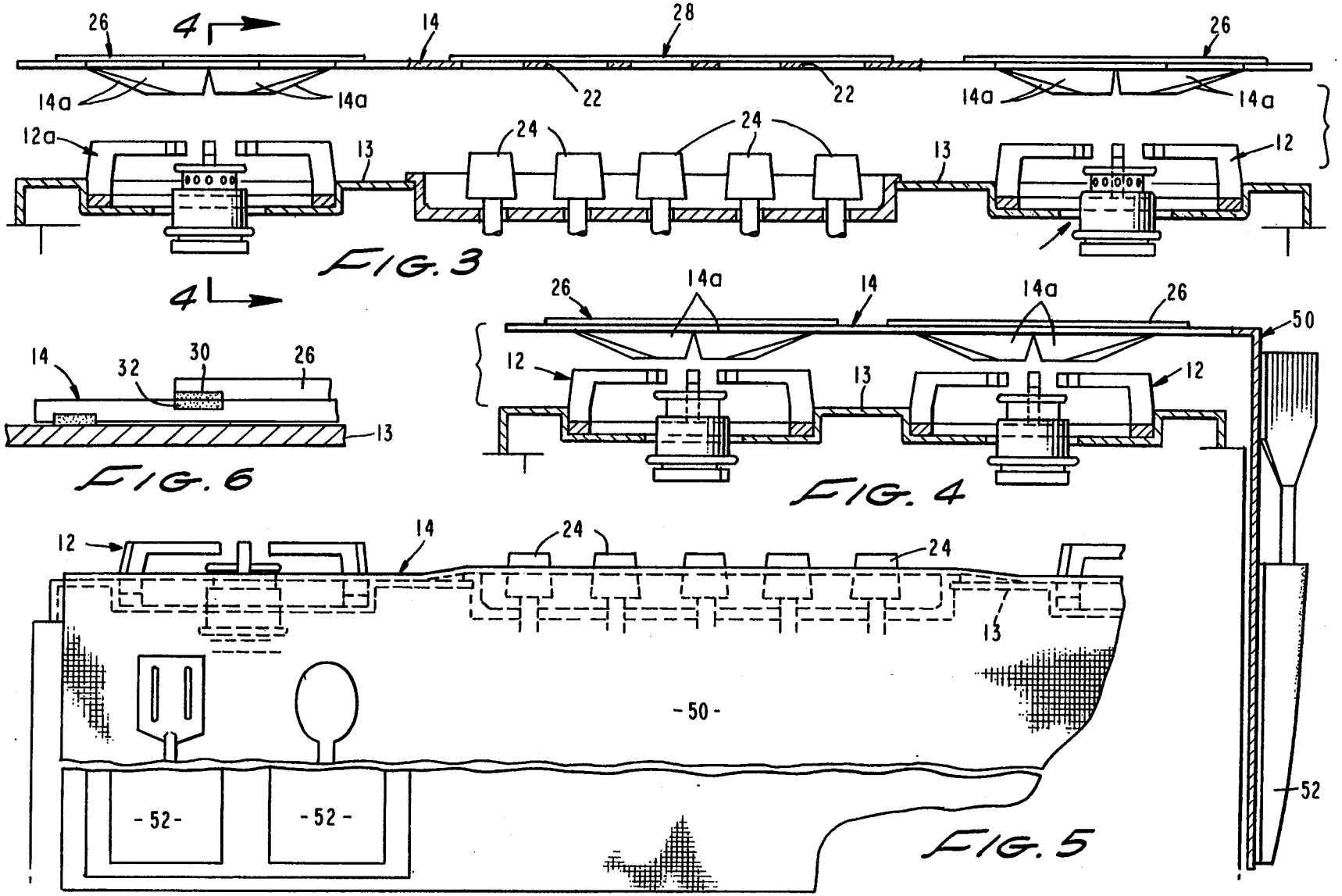
FIG. 3 is a cross-sectional view taken along lines 3—3 of FIG. 1 and showing the protective cover superimposed over the range.
FIG. 4 is a cross-sectional view taken along lines 4—4 of FIG. 3.
FIG. 5 is a view taken along lines 5—5 of FIG. 2.
FIG. 6 is a fragmentary, cross-sectional view illustrating one form of connecting means of the invention for removably interconnecting the griddle cover and burner covers to the body of the cook top protector.

Referring also to FIGS. 2, 3 and 4, the protective cover of the invention can be seen to comprise a flexible, fabric-like body portion 14 which generally corresponds in size and shape to the stove top to be covered. Body portion 14 includes burner overlay portions provided in the form of cutouts adapted to overlay the burner locations and the griddle location. In FIG. 2, the burner overlay portions comprise burner cutout portions 18 and griddle cutout portion 20. A plurality of apertures 22 are also provided in the cover portion to closely receive the control knobs of the stove 24 (see also FIG. 8). Depending upon the type of control knobs provided, it is to be understood that cover body portion 14 can be appropriately apertured or otherwise configured to best accommodate the particular control knobs involved.

A unique feature of the present invention comprises overlay portions or panels which are adapted to cover the various cutout portions provided in the body portion 14. For example, in the embodiment of the invention shown in FIG. 2, there is provided a plurality of burner overlay panels 26 as well as a griddle overlay panel 28. Each of these panels is preferably constructed from a flexible fabric-like material having marginal portions that are provided with fastener means for removably connecting the panels to body portion 14. Turning to FIG. 6, the form of the fastener means there illustrated comprises a multiplicity of small loops 30 provided on each of the panels and a multiplicity of small hooks 32 provided proximate the margins of each of the cutout portions 18 and 20 provided in cover body 14. It is to be understood that, as may be desired, the multiplicity of hooks and multiplicity of loops can be provided on either of the panel perimeters or on the area surrounding the cutout portions of body portion 14. It is also be understood that a variety of other types of fastener means other than the illustrated fastener means which are sold under the trademark VELCRO can be used. For example, a variety of different types of mechanical arrangements such as snaps, hooks and grommets and the like can also be used to removably affix the various panels to the cover body portion 14.

Figure 7:
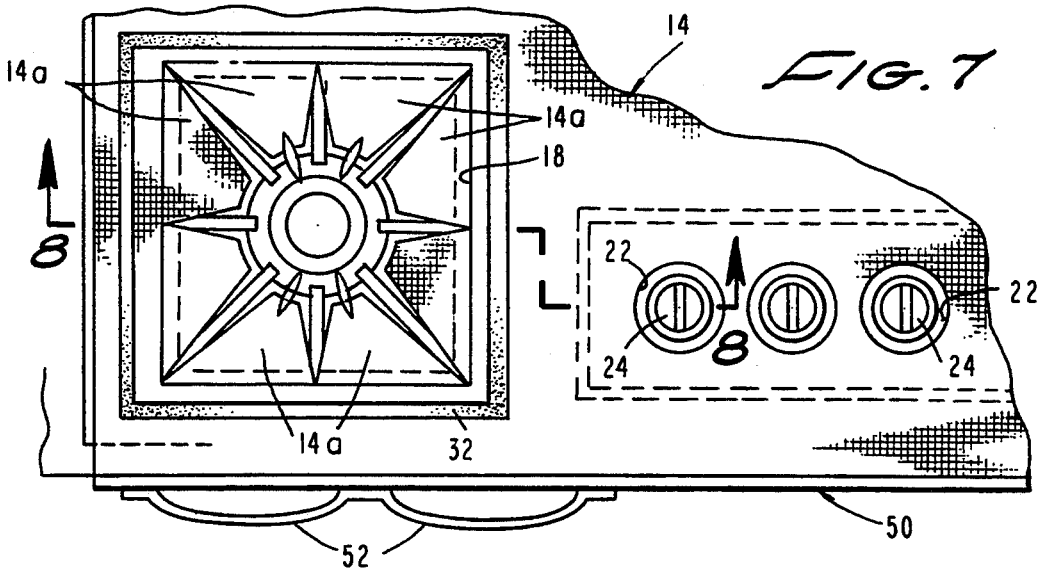
FIG. 7 is a fragmentary plan view of another form of the present invention.
Figure 8:
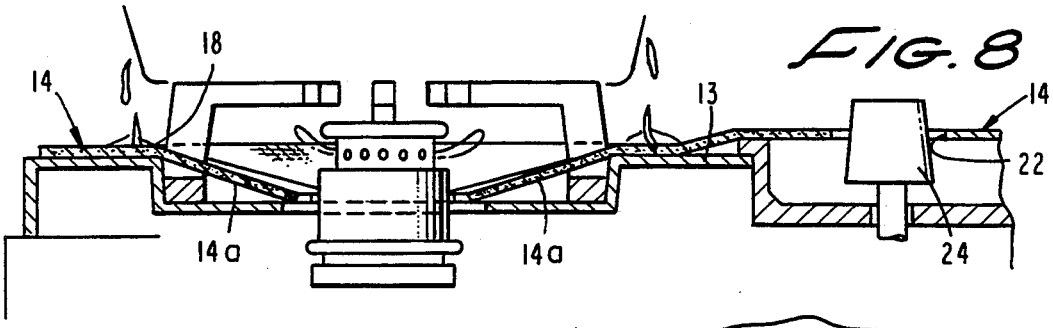
FIG. 8 is a cross-sectional view taken along lines 8—8 of FIG. 7.

Turning particularly to FIG. 3, 4, 7 and 8, another important aspect of the apparatus of the present invention resides in the provision of a plurality of downwardly depending segments **14*a* which depend downwardly from body portion 14 in the area of the stove burner overlay portions. As best seen in FIGS. 7 and 8, when the protective cover is positioned over the stove top, segments 14***a* depend downwardly into the burner well or burner sump portion of the burner unit. The segments are specially configured to substantially cover the upper surfaces of the burner wells in a manner to protect the surfaces from becoming soiled with spattering grease and the like. Segments 14*a* are preferably formed by slitting the body at strategic locations proximate the burner overlay portions so that the segments or flaps are free to generally conform with the upper wall portions of the burner wells in the manner shown in FIG. 8.

Figure 11:
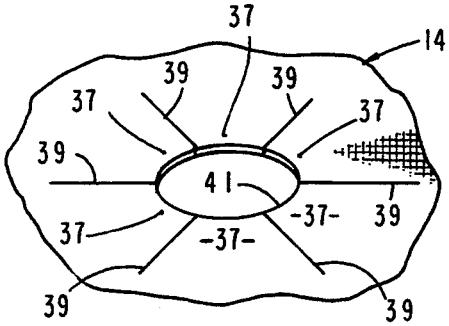
FIG. 11 is a fragmentary, generally perspective view of the portion of the protective covering which includes flaps that are receivable within the burner well.
Figure 9:
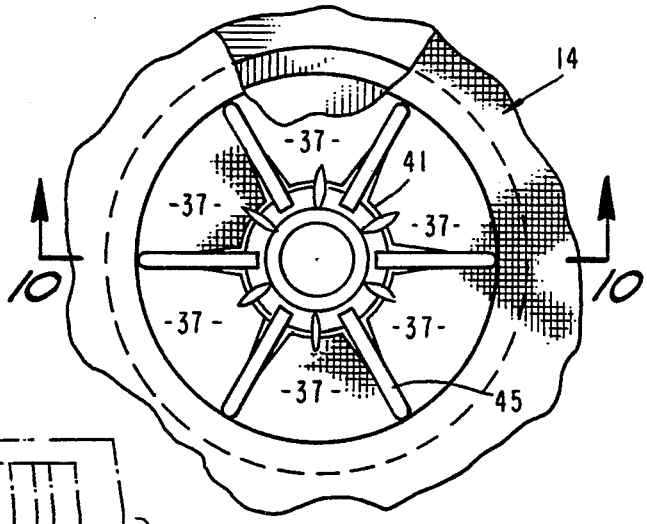
FIG. 9 is a fragmentary plan view of another form of the invention wherein the grates are emplaced over protective flaps that are received in the burner well.
Figure 10:
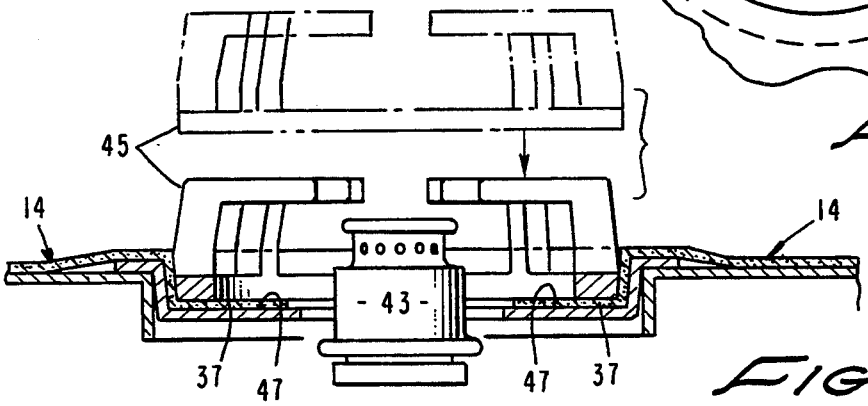
FIG. 10 is a cross-sectional view taken along lines 10—10 of FIG. 9 showing the manner in which the grate is set onto the sump covering flaps.

Referring now to FIGS. 9, 10 and 11, another form of protective cover of the invention is there illustrated. In this form of the invention, the burner well covering segments 37 are of a slightly different configuration and as shown in FIG. 11, are formed by cutting a plurality of slits 39 in the covering. As illustrated in the drawings, slits 39 radiate radially outwardly from an aperture 41 which is provided in the cover portion proximate the location of the burner elements, for example, element 43 of the stove unit. Segments 37 are uniquely constructed and arranged so that they can be held securely in position within the burner sump by placing the grate units 45 of the burner on top of the segments in a manner to force them into conformance with the bottom surface 47 of the burner wells. In using the cover of this form of the invention, the burner grates are first removed from the stove, the protective cover is then emplaced over the stove top and finally the burner grates are placed on top of the segments 37 which naturally depend downwardly into the burner well of the burner unit.

As best seen in FIGS. 5 and 7, another important feature of the apparatus of the present invention resides in the provision of a skirt portion 50 which depends downwardly over the front vertical surface of the stove in the manner illustrated in FIG. 5. Skirt portion 50 is preferably provided with a plurality of pockets 52 which are adapted to support cooking utensils of various kinds, such as the spatula and spoon illustrated in FIG. 5. In certain forms of the invention, skirt portions can also be provided that are adapted to extend downwardly over the sidewalls of the stove.

Body portion 14 as well as panels 26 and 28 can be constructed of a wide variety of fireproof or fire retardant materials. For example, these members can be constructed from a multiplicity of small glass fibers or fine metal strands such as steel or alumimun which are woven into a fabric-like construction. When metal strands are used, the strands can, if desired, be over coated with a material such a polytetrafluro-ethylene. Alternatively, the members can be constructed from various natural or synthetic fibers that have been appropriately treated with fire retardant chemicals such as brominated aeromatics, chlorinated cycloaliphatics and like chemicals. Other types of flame retardant additives of a character well known to those skilled in the art can also be used in connection with a number of different types of natural and synthetic fibers that can be woven into a fabric-like construction.

Preferably the cover body portion as well as the panel portions are constructed from a fire retardant fabric of a character that can exhibit decorative indicia and can be produced in a variety of color schemes which make them suitable for use in the kitchens of fine homes. The apparatus, when thus constructed, is attractive, light-weight, easy to use and easy to fold for convenient storage and is readily washable in conventional types of washing machines.

In use, all but the burner or burners then being operated remain covered with the covering panels so as to protect the burners and griddle portion of the stove from spattering grease and the like. Because the panels are readily removable from the cover body portion, as additional burners are required, or when the griddle is required for cooking operations, the panels can be quickly removed and then replaced following completion of the cooking operation. As required, the entire cover along with some or all of the covering panels can be removed, washed and dried, and replaced on the stove top for repeated use. In this way, the stove top as well as the burner wells and the griddle surface is protected from grease splattering, messy boil-over and soil caused by dislodged food particles.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A protective cover for use with a stove top of the character having at least two burner locations surrounded by a top surface, said cover comprising:

(a) a flexible, fabric-like body portion generally corresponding in size and shape to the stove top, said body portion having burner overlay portions adapted to overlay the burner locations, each of said burner overlay portions comprising a plurality of segments adapted to depend downwardly from said body portion; and (b) at least two panels removably connected to said body portion, said panels being adapted to overlay said burner overlay portion.

2. A cover as defined in claim 1 in which said panels are constructed from a flexible, fabric-like material and in which said cover further includes fastener means for removably connecting said panels to said body portion.

3. A cover as defined in claim 2 in which said fastener means comprises a multiplicity of small loops provided on one of said body portion and said panels and a multiplicity of small hooks provided on the other of said one of said body portion and said panels.

4. A cover as defined in claim 2 in which said body portion includes a skirt portion, said skirt portion having a plurality of pockets provided thereon.

5. A protective cover for use with a stove top of the character having a top surface and at least two burner locations each having a sump portion, said cover comprising:

(a) a flexible fire retardant, cloth-like body portion generally corresponding in size and shape to the stove top, said body portion having burner overlay portions adapted to overlay the burner locations, each said burner overlay portions having a plurality of segments adapted to depend downwardly into the sump portions of the burner locations;

(b) at least two fire retardant panels removably connected to said body portion, said panels having marginal portions and being adapted to overlay said burner overlay portions; and (c) fastener means for removably connecting said panels to said body portion.

6. A cover as defined in claim 5 in which said fastener means comprises a multiplicity of small loops provided on said body portion and a multiplicity of small hooks prevented along said marginal portions of said panels.

7. A cover as defined in claim 5 in which said body portion includes a flexible, fabric-like skirt portion, said skirt portion having a plurality of pockets provided thereon.

8. A cover as defined in claim 5 in which said body portion and said panels are constructed from a multiplicity of interwoven fibers of glass.

9. A cover as defined in claim 5 in which said body portion and said panels are constructed from a fabric that has been impregnated with a fire retardant chemical.

10. A protective cover for use with a stove top of the character having a top surface, a griddle and at least two burner locations, each said burner location having a sump portion, said cover comprising:

(a) a flexible fire retardant, cloth-like body portion generally corresponding in size and shape to the stove top, said body portion having a griddle overlay portion adapted to overlay the griddle portion and burner overlay portions adapted to overlay the burner locations, each said burner overlay portions having a plurality of segments adapted to depend downwardly into the sump portions of the burner locations; portion;

(c) at least two fire retardant burner panels removably connected to said body portion, said burner panels having marginal portions and being adapted to overlay said burner overlay portions; and (d) fastener means for removably connecting said griddle panel and said burner panels to said body portion.

11. A cover as defined in claim 10 in which said fastener means comprises a multiplicity of small loops provided on said body portion and a multiplicity of small hooks provided along said marginal portions of said griddle panel and said burner panels.

12. A cover as defined in claim 10 in which said body portion includes a flexible, fabric-like skirt portion, said skirt portion having a plurality of pockets provided thereon.

13. A cover as defined in claim 12 in which said skirt portion, said body portion, said griddle panel and said burner panels are constructed from a multiplicity of interwoven fibers of glass.

14. A cover as defined in claim 11 in which said skirt portion, said body portion, said griddle panel and said burner panels are constructed from a multiplicity of find strands of metal which are interwoven together.

15. A cover as defined in claim 11 in which said body portion, said griddle panel and said burner panels are constructed from a fabric that has been impregnated with a fire retardant chemical.

* * * * *